United States Patent [19]

Aldcroft et al.

[11] 4,366,957

[45] Jan. 4, 1983

[54] GAME APPARATUS

[75] Inventors: Gary T. Aldcroft, Prior Lake; Robert L. Claussen, Crystal, both of Minn.; A. Edward Fogarty; Bonnie R. Fogarty, both of Sarasota, Fla.; John P. Kearney, Maple Grove, Minn.

[73] Assignee: Leisure Dynamics, Inc., Minneapolis, Minn.

[21] Appl. No.: 227,811

[22] Filed: Jan. 23, 1981

[51] Int. Cl.[3] ..... A63F 9/00

[52] U.S. Cl. ..... 273/1 GF

[58] Field of Search ..... 273/1 GF, 1 GL, 86 R, 273/DIG. 25; 434/259; 124/7

[56] References Cited

U.S. PATENT DOCUMENTS

| | | | |
|---|---|---|---|
| 2,208,952 | 7/1940 | Ward | 273/86 R |
| 3,036,834 | 5/1962 | Zalkind | 273/DIG. 25 X |
| 3,710,455 | 1/1973 | Liversidge et al. | 273/1 GF X |
| 4,114,877 | 9/1978 | Goldfarb et al. | 273/1 GF |

FOREIGN PATENT DOCUMENTS

| | | | |
|---|---|---|---|
| 2301529 | 7/1973 | Fed. Rep. of Germany | 124/7 |
| 2641903 | 3/1978 | Fed. Rep. of Germany | 273/1 GF |

OTHER PUBLICATIONS

Game equipment sold as a unit under the trademark of Mr. Potato Head.

*Primary Examiner*—Paul E. Shapiro

*Attorney, Agent, or Firm*—Schroeder, Siegfried, Vidas, Steffey & Arrett

[57] ABSTRACT

An upright rearwardly inclined game-piece receiving panel is carried by a panel receiving socket in a base and is movable to a vertical position by a biasing spring acting on the socket. Game-pieces applied to the panel are ejected therefrom upon the expiration of a predetermined period of time when a timer mechanism also carried by the base member releases a latch mechanism holding the socket inclined against the bias of the spring. The panel is preferably shaped like a human head. The game-pieces preferably resemble facial features and have bases shaped complementary to recesses formed in the panel at appropriate locations and are selected by the player as a component of a face by reference to a design on a card. The game is won by first selecting the appropriate game pieces and applying them to the panel to produce the prescribed composite design and then manually stopping the timer mechanism before it causes the game-pieces to be ejected from the panel.

1 Claim, 13 Drawing Figures

GAME APPARATUS

DESCRIPTION

BACKGROUND OF PRIOR ART

Game apparatus heretofore known has included various game pieces each designed to be reviewed within one of a plurality of slots formed for that purpose in a panel cut to a particular shape, so to resemble a particular configuration. An example was a puzzle known as Mr. Potato-Head in which the panel was slotted, colored and shaped to resemble a potato and the game pieces had humanoid features and were received within the slots to produce a comical figure. Such apparatus however had no competitive aspects and was relatively inactive so that maximum enjoyment was not attainable. U.S. Pat. No. 3,710,455 shows another form of game apparatus in which the game pieces are shaped to conform to individual and differently shaped recesses in a fixed panel.

BRIEF SUMMARY OF THE INVENTION

Our invention provides game apparatus having an upright panel mounted upon a base member and pivoted means associated therewith for ejecting, upon the passage of a predetermined period of time, a plurality of fame pieces from the face of the panel, the game pieces being designed to be received in correspondingly shaped recesses in the panel face. The panel is preferably shaped to resemble a human head and the game pieces are preferably shaped and formed to resemble various facial features, the object of the game being to select from several the correct facial feature as a component of a facial design shown on a card and to apply the same to the panel, the game being won when correct facial features have been found and applied to complete the composite design before the predetermined time period expires.

It is a general object of our invention to provide novel and highly competitive game apparatus which develops skills and yet is highly enjoyable.

A more specific object is to provide game apparatus which is simple and relatively inexpensive to manufacture and yet is highly enjoyable, competitive, and skill-developing to players of a relatively wide age span.

BRIEF DESCRIPTION OF THE DRAWINGS

A detailed description of one preferred embodiment is hereafter described with specific reference being made to the drawings in which.

DETAILED DESCRIPTION OF INVENTION

Figure 3:
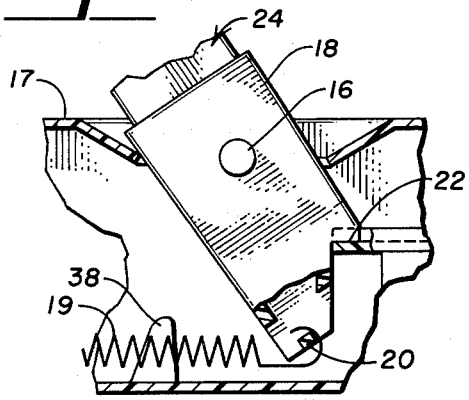
FIG. 3 is a fragmentary sectional view on an enlarged scale taken along line 3—3 of FIG. 1.
Figure 4:
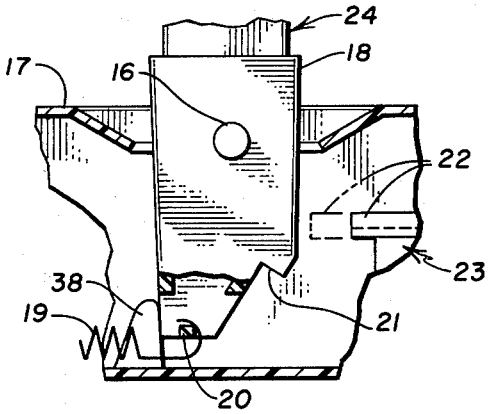
FIG. 4 is a fragmentary sectional view on an enlarged scale take along line 4—4 of FIG. 2.
Figure 5:
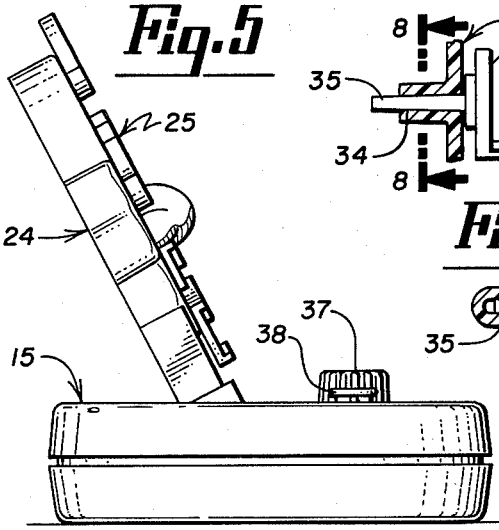
FIG. 5 is a side elevational view thereof in cocked position and assembled just prior to release of the panel.

The preferred embodiment of the invention is shown in FIGS. 1–8 and is comprised of a base member 15 which rotatably supports a transverse pivot shaft 16 at a level slightly below the upper surface 17 thereof. Mounted on the shaft 16 for pivotal movement therewith is a socket member 18 which has a generally rectangular opening therewithin and is urged rearwardly at its lower end by a spring 19 which is anchored at its rearward end to the base member 15 and is connected to the lower rearward corner of the socket member as at 20. The forward lower corner of the socket member 18 is relieved as best shown in FIGS. 3 and 5 to provide a detent or latch element 21 which is positioned and shaped to cooperate with a latching tongue 22 which is part of a slidable latching mechanism similar in construction to that disclosed in U.S. Pat. No. 3,710,455 issued Jan. 16, 1973 to Liversidge and Begley, entitled "Educational Game".

The latching mechanism has been indicated generally as 23 and is not shown in detail.

Figure 1:
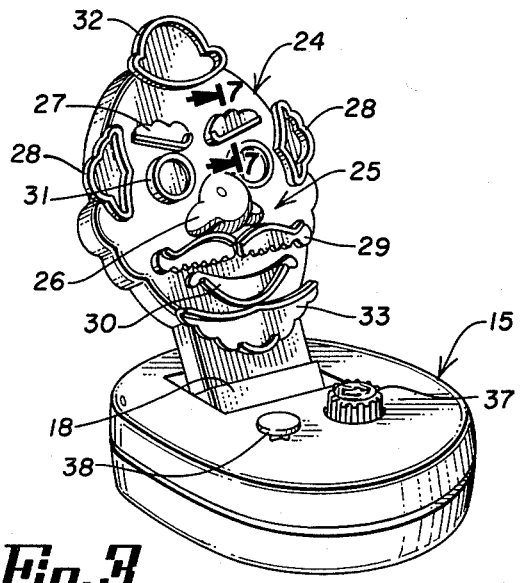
FIG. 1 is a front perspective view of the preferred embodiment of our invention in cocked position and assembled just prior to release of the panel by the time.
Figure 2:
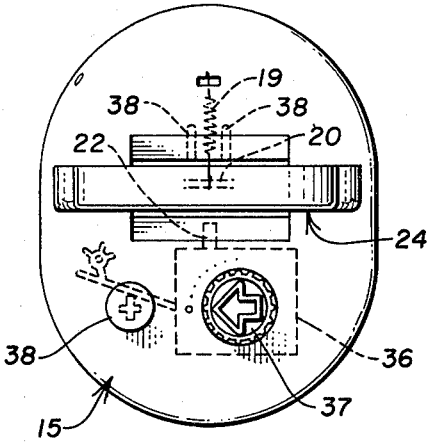
FIG. 2 is a top plan view thereof while in released position.

Mounted within the socket member 18 and extending upwardly therefrom is a panel member 24 which has a plurality of recesses formed therein of different shapes so as to receive one of a number of various game pieces indicated generally as 25 which are shaped and formed so as to resemble different facial features, preferably of a comical nature. As best shown in FIG. 1, game pieces may include a plurality of nose pieces 26, eyebrows 27, ears 28, mustache 29, mouth 30, and eyeballs 31. In addition, it may include wearing apparel such as a hat 32, and a necktie 33. Each of the game pieces representing a particular facial feature or a piece of wearing apparel has a base which is shaped complementarily to the particular recess at the location on the panel member 24 at which that game piece is to be applied. A plurality of various game pieces are provided for each facial feature location so as to make the game more difficult for players of more adult age. Cards which are composites of different facial designs of different appearances are provided and the object of the game is to select the correct facial pieces and wearing apparel game pieces and apply the same to the panel in the correct positions within a predetermined time period which is described hereinafter.

Figure 7:
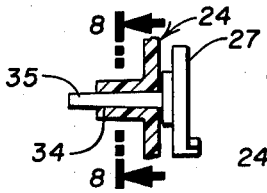
FIG. 7 is a sectional view of an enlarged scale taken along line 7—7 of FIG. 1.
Figure 8:
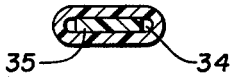
FIG. 8 is a sectional view on an enlarged scale, taken along line 8—8 of FIG. 7.

FIG. 7 shows the game panel 24 having an opening 34 within which complementarily-shaped base element 35 of the game piece 27 is received. FIG. 8 shows the particular configuration of the opening 34 when viewed along 8—8 of FIG. 7. Each of the openings may have a different configuration, if so desired.

The latching mechanism 23 and its latch tongue 22 are controlled as described in the patent identified hereinabove by a timer mechanism indicated generally as 36.

Figure 6:
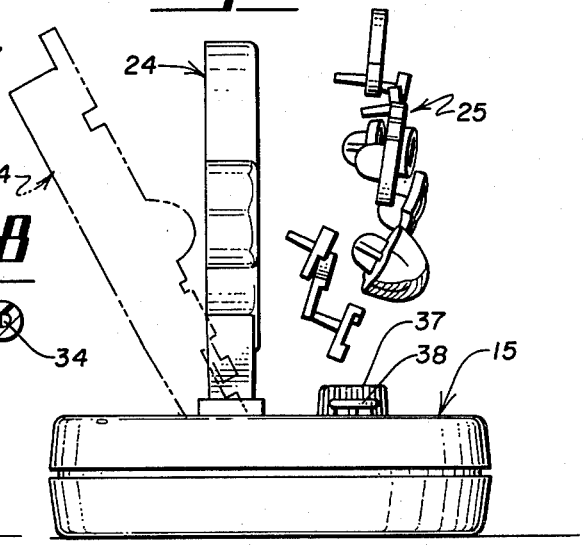
FIG. 6 is a side elevational view thereof, just after the panel has been released.

This timer mechanism can be constructed in the same manner as indicated in the above U.S. Pat. No. 3,710,455 and includes setting knob 37 and a start/stop button 38 by means of which the timer mechanism may be started or stopped as desired. When the timer mechanism is turned to a set of cocked position, the panel member 24 is swung rearwardly to the position shown in FIG. 1, against the bias of the spring 19, and the watch tongue 22 is urged rearwardly by its activating spring to its latching position as shown in FIG. 3. If the player is successful in selecting and assimilating the composite design to which he has reference upon a previously selected card, he may stop the timer mechanism by pressing the stop button 38, thereby winning the game. If the player is unsuccessful, however, in selecting and applying each of the proper game pieces in accordance with the composite design as shown on the selected card, upon expiration of the selected time period the timer mechanism 36 will release the latch 23 and the latching tongue will thereupon be drawn forwardly as shown in FIG. 4. When this occurs, the socket pivots rapidly to the vertical position shown in FIG. 4 and the lower left corner thereof strikes an upstanding abutment member 38 which is carried by the bottom wall of the base member 15. When this occurs, all of the game pieces are ejected forward from the panel 24 as best shown in FIG. 6. FIG. 5 illustrates the position of the panel member 24 while the game is in progress and while the player is engaged in selecting the appropriate game pieces and applying them to the complementarily-shaped recesses in that panel member.

From the above, it can be seen that we have provided a simple and relatively inexpensive action-type game which is highly competitive and develops skills in recognizing and selecting corresponding shapes, features and designs and yet is highly enjoyable. Moreover, it is readily adaptable to players having a relatively wide age span particularly when three or more game pieces for each facial location are provided, thereby complicating the game process and requiring more improved skills in the selection of the proper game piece.

FIGS. 9–13 inclusive shows a second form of our invention. As shown, it includes a base member 40 having an upstanding panel member 41 rigidly affixed thereto. The panel member has a plurality of openings as indicated by the numeral 42 within each of which one of a number of game pieces 43 is adapted to be received in the same manner and with similar construction as those described hereinabove with respect of FIGS. 1–8 inclusive. To facilitate the description, these individual game pieces are identified by the same numerals as those utilized in FIG. 1.

Figure 11:
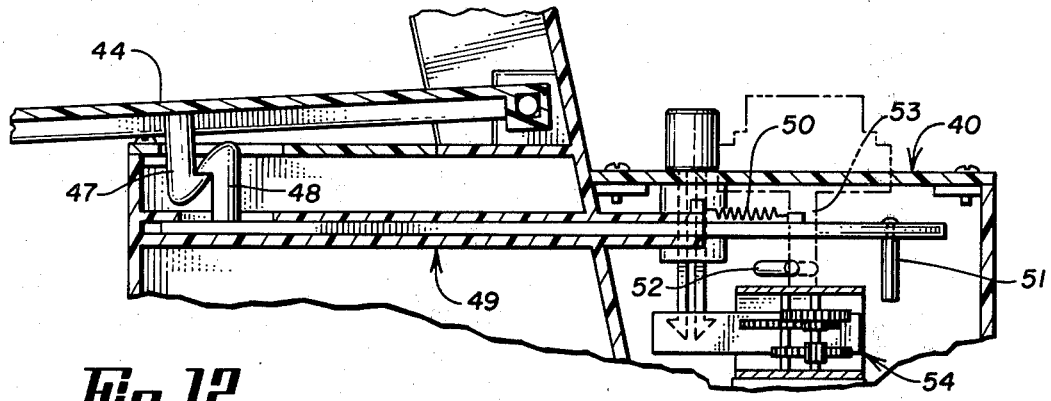
FIG. 11 is a fragmentary sectional view, taken along line 11—11 of FIG. 10.
Figure 12:
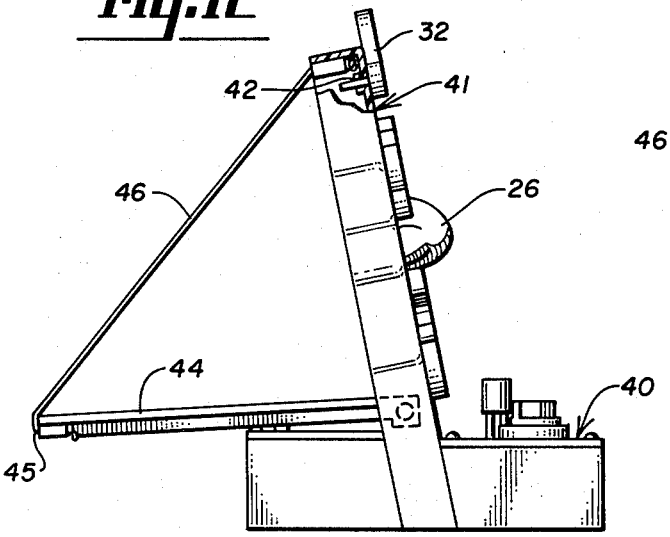
FIG. 12 is a side elevational view of the embodiment shown in FIG. 9 in cocked position.

Pivotally mounted upon the backside of the panel 41 is a second panel member 44 which is connected at its free end as at 45 with an elastic cord 46 which is anchored at its upper end to the upper end of the panel member 41 as best shown in FIG. 12. Mounted upon the backside of the panel member 44 and extending outwardly therefrom is a latch element 47 which is positioned to engage an interlocking latch member 48 carried by a latching mechanism 49 which is best shown in FIG. 11. As shown, the latching member 48 is slidably mounted on the base member 40 and is constantly urged forwardly by a spring member 50 which is anchored to the base member as best shown in FIG. 11. A cam element 51 is carried by the forward end of the slidable latch member 48 in depending position and is engaged by an arcuate cam 52 which is mounted upon and carried by the vertical shaft 53 of the timing mechanism indicated generally as 54. Thus, when the timer mechanism 54 is set, the cam member is withdrawn out of contact with the cam element 51 and the latch member 48 is moved by the spring 50 into latching position as shown in FIG. 11 to hold the panel member 44 in tensioned position, the elastic cord 46 strongly urging the same upwardly.

Figure 9:
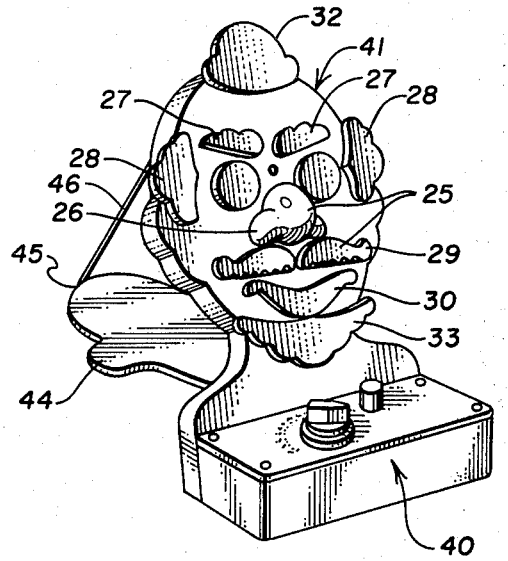
FIG. 9 is a front perspective view of a second embodiment of our game apparatus, in cocked position and with each of the game pieces in position.
Figure 10:
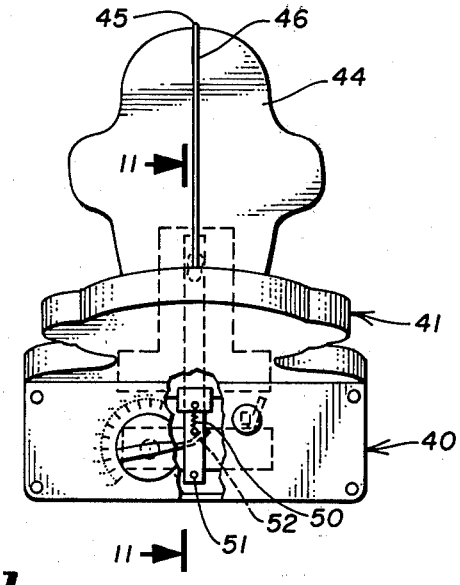
FIG. 10 is a rear elevational view of the embodiment of FIG. 9, with portions broken away to show the interior.
Figure 13:
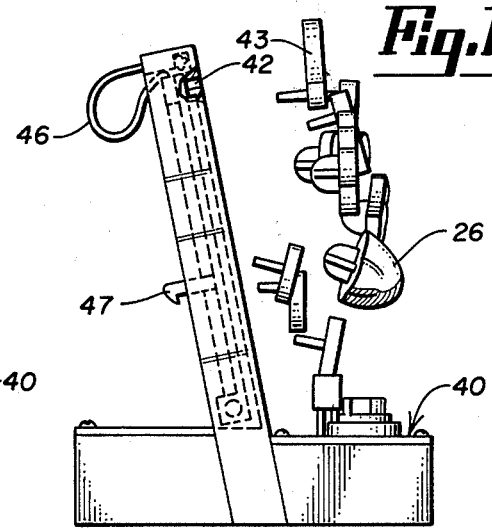
FIG. 13 is a side elevational view of the embodiment shown in FIG. 9 immediately following the ejection of the playing pieces after release of the timer.

FIG. 12 shows the panel member 44 in such restrained and biased position while the game pieces 43 are being applied by the player to the front surface of the upstanding panel member 41. In the event the player is successful in selecting and positioning all of the features and wearing apparel as shown in FIG. 9 before the predetermined time period expires and the camming member 52 engages the cam element 51 to withdraw the latch element 48, then the player will win the game. On the other hand, if a predetermined period of time expires, the camming element 52 will urge the cam element 51 to the right, as shown in FIG. 11, thereby releasing the latch element 47 permitting the elastic cord 40 to cause the panel 44 to swing upwardly and strike the rear ends of the game pieces 43, thereby causing them to be ejected as shown in FIG. 13.

While the form of the invention shown in FIGS. 9–13 inclusive is practical and enjoyable, we prefer embodiment shown in FIGS. 1–8 inclusive particularly in view of the fact that it can be packaged in smaller compass and offers less problems in manufacturing the same.

In considering this invention, it should be remembered that the present disclosure is illustrative only and the scope of the invention should be determined by the appended claims.

We claim:

1. Game apparatus comprising:

(a) a base member;

(b) an upright panel pivotally mounted upon said base member for limited pivotal movement between vertically and rearwardly inclined positions only and having a forwardly facing surface constructed and arranged to receive thereon game pieces which are selected in accordance with a predetermined design;

(c) bias means carried by said base member and connected to said upright panel and continuously urging the latter forwardly toward vertically extending position;

(d) retaining mechanism carried by said base member and associated with said panel and constructed and arranged to releasably hold the latter in biased rearwardly inclined position; and (e) timing mechanism connected with said retaining mechanism in releasing relation and constructed and arranged to cause the latter to release said panel upon the expiration of a predetermined period of time to thereby permit said panel to be snapped forwardly to its vertically extending position by said bias means and thereby cause the game pieces received by said forwardly facing surface to be ejected therefrom.

* * * * *